US007138995B2

(12) United States Patent
Wang et al.

(10) Patent No.: US 7,138,995 B2
(45) Date of Patent: Nov. 21, 2006

(54) CIRCUIT FOR DRIVING LED DISPLAY

(75) Inventors: Bily Wang, Hsin Chu (TW); John Lin, Chia I Hsien (TW)

(73) Assignee: Harvatek Corporation, Hsin Chu (TW)

( * ) Notice: Subject to any disclaimer, the term of this patent is extended or adjusted under 35 U.S.C. 154(b) by 498 days.

(21) Appl. No.: 10/795,310

(22) Filed: Mar. 9, 2004

(65) Prior Publication Data

US 2005/0200577 A1 Sep. 15, 2005

(51) Int. Cl.
*G09G 5/00* (2006.01)
*G09G 3/10* (2006.01)

(52) U.S. Cl. ..... 345/212; 345/76; 345/82; 345/213; 315/169.1; 315/169.2; 315/169.3

(58) Field of Classification Search ..... 345/76, 345/82, 211–214, 690; 315/169.1–169.4
See application file for complete search history.

(56) References Cited

U.S. PATENT DOCUMENTS

| | | | | |
|---|---|---|---|---|
| 6,774,878 | B1 * | 8/2004 | Yoshida et al. | 345/76 |
| 7,042,164 | B1 * | 5/2006 | Yazawa | 315/169.3 |
| 2004/0145583 | A1 * | 7/2004 | Morita | 345/211 |
| 2005/0219163 | A1 * | 10/2005 | Smith et al. | 345/76 |

* cited by examiner

*Primary Examiner*—Henry N. Tran
(74) *Attorney, Agent, or Firm*—Rosenberg, Klein & Lee

(57) ABSTRACT

A circuit for driving a light-emitting diode (LED) display has multiple driving modes. The circuit has a control unit for outputting a mode-switching signal, a scan driving chip connecting with the control unit for providing a scan signal, a data driving chip connecting with the control unit and the scan driving chip for providing a data signal, a row control interface connecting with the row line, the control unit, the scan driving chip and the data driving chip to receive the mode-switching signal for switching an input end of the row control interface, and a column control interface connecting with the column line, the control unit, the scan driving chip and the data driving chip to receive the mode-switching signal for switching an input end of the column control interface.

7 Claims, 4 Drawing Sheets

CIRCUIT FOR DRIVING LED DISPLAY

FIELD OF THE INVENTION

The present invention is directed to a circuit for driving a light-emitting diode (LED) display, and more particularly, to a driving circuit of an LED display that has multiple driving modes.

BACKGROUND OF THE INVENTION

With the progress of the information technology, light-emitting diode (LED) displays have become one of the main streams of the electronic products gradually. Recently, most LED displays are often used as, for example, advertisement boards, activity-announcements boards, traffic lights, and outdoor television walls. Via controlling the motion pictures and texts shown on the LED displays, the LED displays can be used for advertising, announcements or traffic warming. Hence, they are very profitable for advertising products, announcements, passing immediate messages and displaying.

Reference is made to FIG. 1, which is a circuit block diagram of a conventional circuit for driving an LED display. The conventional circuits for driving an LED display usually connects a scan driving chip 22 with multiple row lines (R1, R2, R3 . . . Rn) of a display 20 to provide scan signals to the row lines (R1, R2, R3 . . . Rn) and connects a data driving chip 24 with multiple column lines (C1, C2, C3 . . . Cn) of a display 20 to provide data signals to the column lines (C1, C2, C3 . . . Cn). In this way, the display unit 202 can be controlled by the scan driving chip 22 and the data driving chip 24 via a pair of the row and column lines.

Therefore, the conventional circuit for driving the LED display can only use the row lines (R1, R2, R3 . . . Rn) to scan and use the column lines (C1, C2, C3 . . . Cn) to transmit data. In fact, the conventional LED display lacks flexible control for reaching optimum light-emitting efficiency. Hence, the advertisement board, announcement board, traffic light or outdoor television wall made of the conventional LED display can't have the most flexible, economic, power-saving and efficient control for emitting light, either.

Accordingly, the conventional driving circuits of the LED display still have some drawbacks that could be improved. The present invention aims to resolve the drawbacks in the prior art.

SUMMARY OF THE INVENTION

An objective of the present invention is to provide a circuit for driving an LED display that has multiple driving modes.

To reach the objective above, the present invention provides a circuit for driving an LED display. It connects a row control interface and a column control interface with row lines and columns lines of the LED display, respectively. It employs a control unit to control the row control interface and column control interface.

Furthermore, the circuit employs a scan driving chip and a data driving chip connecting with the row control interface and column control interface to output scan signals and data signals and send the signals to the row and column lines of the LED display under the control of the control unit to perform a driving mode.

In the description above, the driving mode of the present invention can be:

Mode 1: row lines for scanning and column lines for inputting data signals.

Mode 2: column lines for scanning and row lines for inputting data signals.

Mode 3: row lines for obtaining DC power and column lines for grounding.

Mode 4: row lines for obtaining DC power and column lines for grounding or connecting the floating contacts in accord with the mode-switching signal.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION

Figure 1:
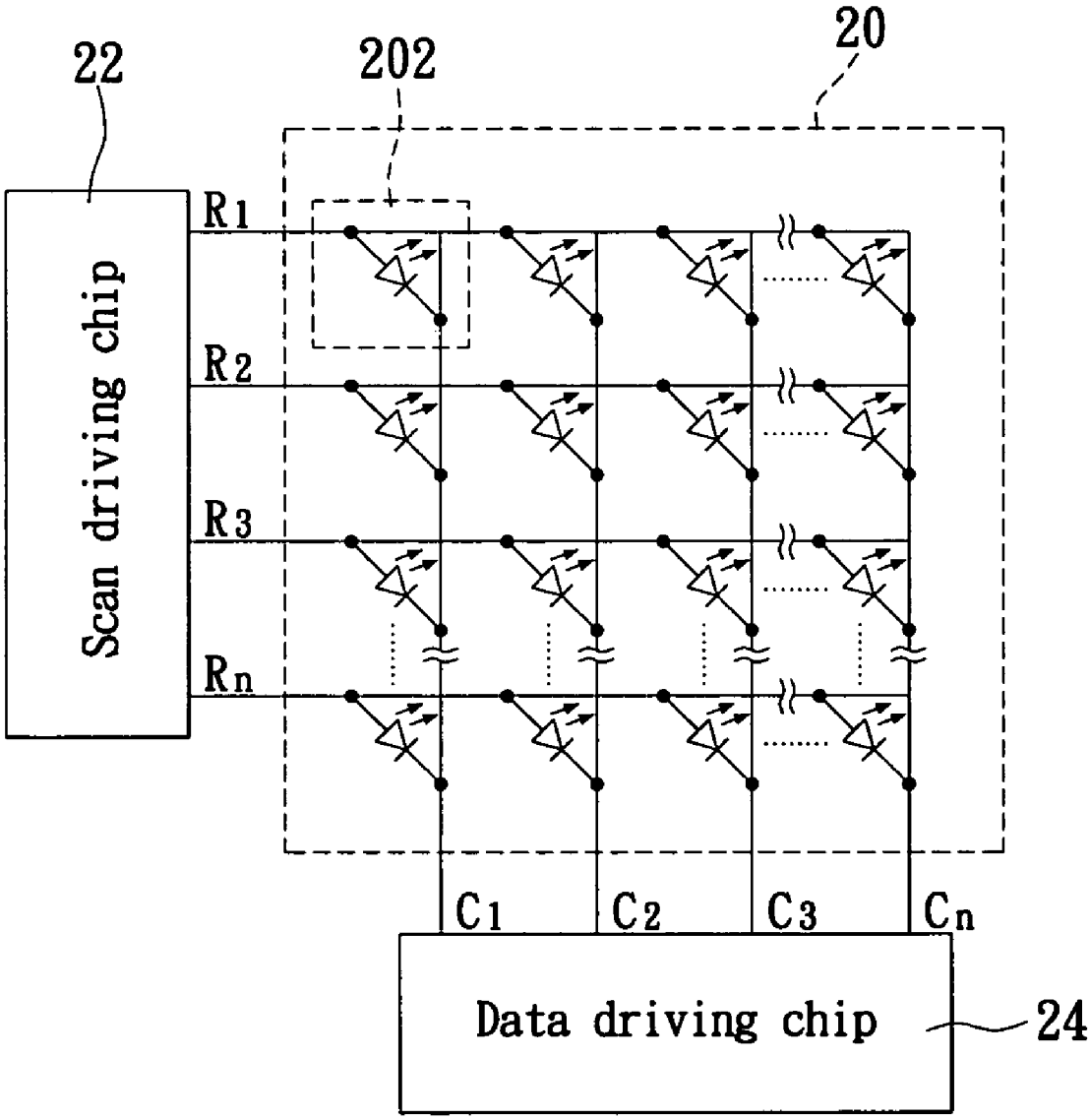
FIG. 1 PRIOR ART
FIG. 1 is a circuit block diagram of a conventional circuit for driving an LED display.
Figure 2:
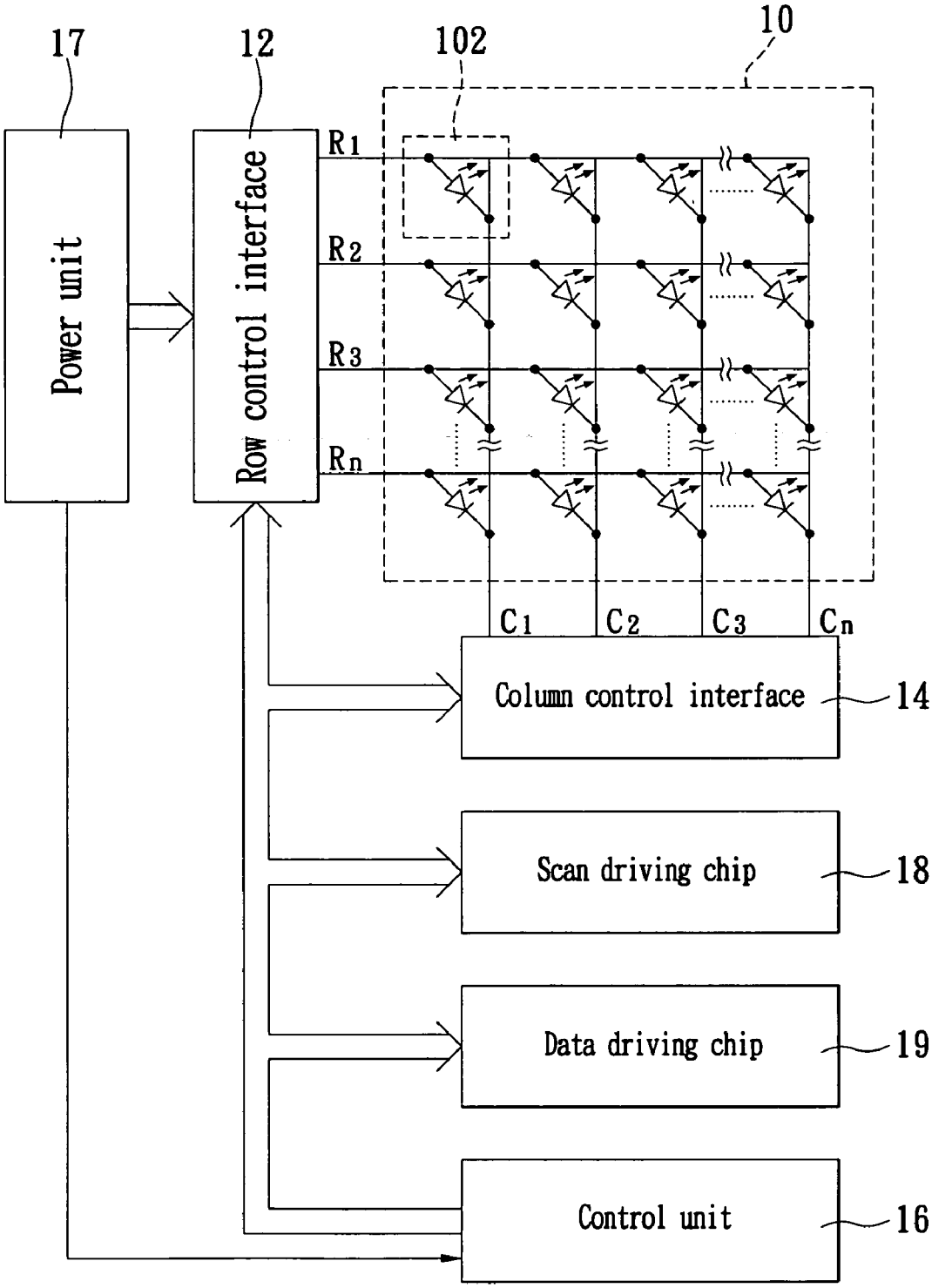
FIG. 2 is a block diagram of a circuit for driving an LED display in accordance with the present invention.

Reference is made to FIG. 2, which is a block diagram of a circuit for driving an LED display in accordance with the present invention. As shown in the figure, the display 10 has the row lines (R1, R2, R3 . . . Rn) and the column lines (C1, C2, C3 . . . Cn). Each of the display units is controlled by a row line and a column line. For example, the row line R1 and column line C1 can control the display unit 102. Further, the row lines (R1, R2, R3 . . . Rn) and the column lines (C1, C2, C3 . . . Cn) respectively connect with a row control interface 12 and a column control interface 14, which both connect with a control unit 16. The control unit 16 can be used to control the row control interface 12 and column control interface 14 via sending a mode-switching signal to them. The display units mentioned above are LEDs or organic LEDs.

In the description above, a scan driving chip 18 is connected with the row control interface 12, column control interface 14 and control unit 16. It is used to output a scan signal under the control of the control unit 16. Further, a data driving chip 19 is also connected with the row control interface 12, column control interface 14 and control unit 16. It is used to output a data signal under the control of the control unit 16.

Furthermore, a power unit 17 is connected with the row control interface 12 and control unit 16 for providing direct current (DC) power to the row control interface 12 and the circuit. The power unit 17 will provide DC power to the row lines (R1, R2, R3 . . . Rn) according to the mode-switching signal sent from the control unit 16 to the row control interface 12.

Figure 3:
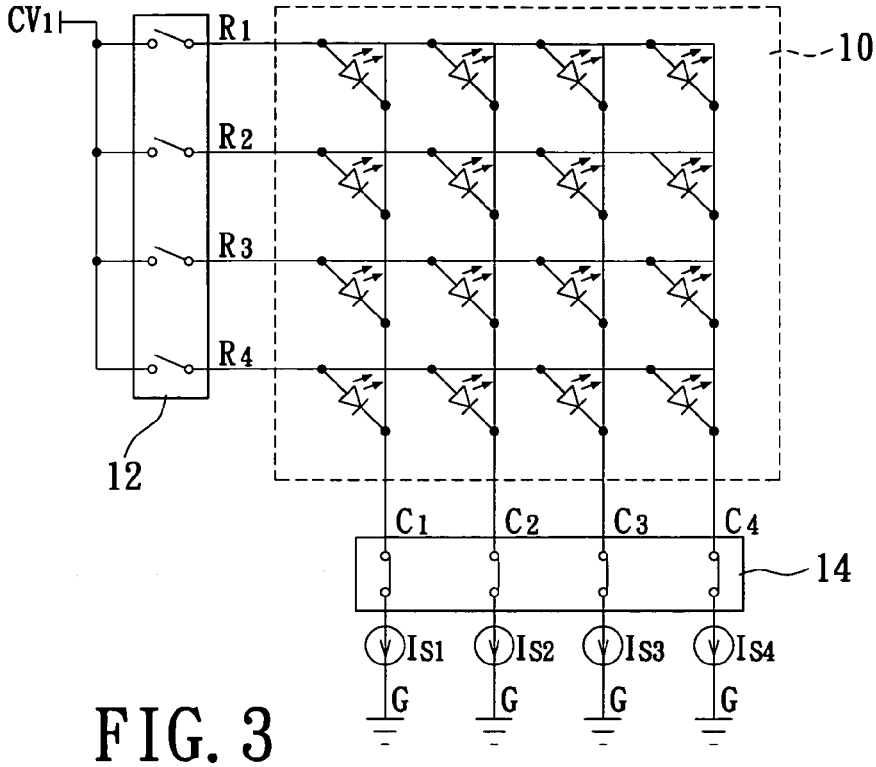
FIG. 3 is a schematic diagram of a driving circuit with the first mode in accordance with the present invention.

Reference is made to FIG. 2 together with FIG. 3, which is a schematic diagram of a driving circuit with the first mode in accordance with the present invention. As shown in the figure, the exemplary embodiment has a display 10 with a 4×4 LED array. The control unit 16 sends a mode-switching signal to the row control interface 12 to make its input end switch to the first DC power CV1, which is provided by the power unit 17. Further, the control unit 16 controls the scan driving chip 18 to provide a scan signal to the row control interface 12. According to the scan signal, the row control interface 12 will repeatedly send the electric power of the first DC power CV1 to the row lines (R1, R2, R3 . . . Rn) in order.

At the same time, the control unit 16 will send the mode-switching signal to the column control interface 14 to make its input ends switch to the data driving chip 19. Then, the data driving chip 19 will provide data signals (Is1, Is2, Is3, Is4) to the column lines (C1, C2, C3 . . . Cn) to make the display 10 emit light for display. In the description above, the data signals are electric current signals.

In the description above, the driving mode of the display 10 employs the row lines for scanning and the column lines for inputting data signals (Is1, Is2, Is3, Is4).

Figure 4:
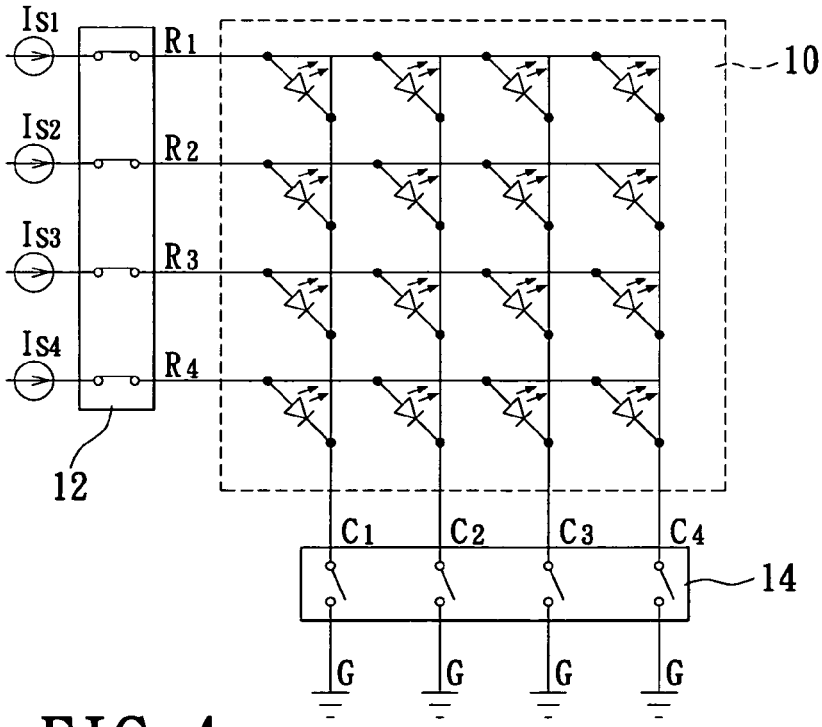
FIG. 4 is a schematic diagram of a driving circuit with the second mode in accordance with the present invention.

Reference is made to FIG. 2 together with FIG. 4, which is a schematic diagram of a driving circuit with the second mode in accordance with the present invention. As shown in the figure, the exemplary embodiment has a display 10 with a 4×4 LED array. The control unit 16 sends a mode-switching signal to the column control interface 14 to make its input ends switch to the grounds G. Further, the control unit 16 controls the scan driving chip 18 to provide a scan signal to the column control interface 14. According to the scan signal, the row control interface 12 will repeatedly send the ground voltage to the column lines (C1, C2, C3 . . . Cn) in order.

At the same time, the control unit 16 will send the mode-switching signal to the row control interface 12 to make its input ends switch to the data driving chip 19. Then, the data driving chip 19 will provide data signals (Is1, Is2, Is3, Is4) to the row lines (R1, R2, R3 . . . Rn) to make the display 10 emit light for display.

In the description above, the driving mode of the display 10 employs the column lines for scanning and the row lines for inputting data signals (Is1, Is2, Is3, Is4).

Figure 5:
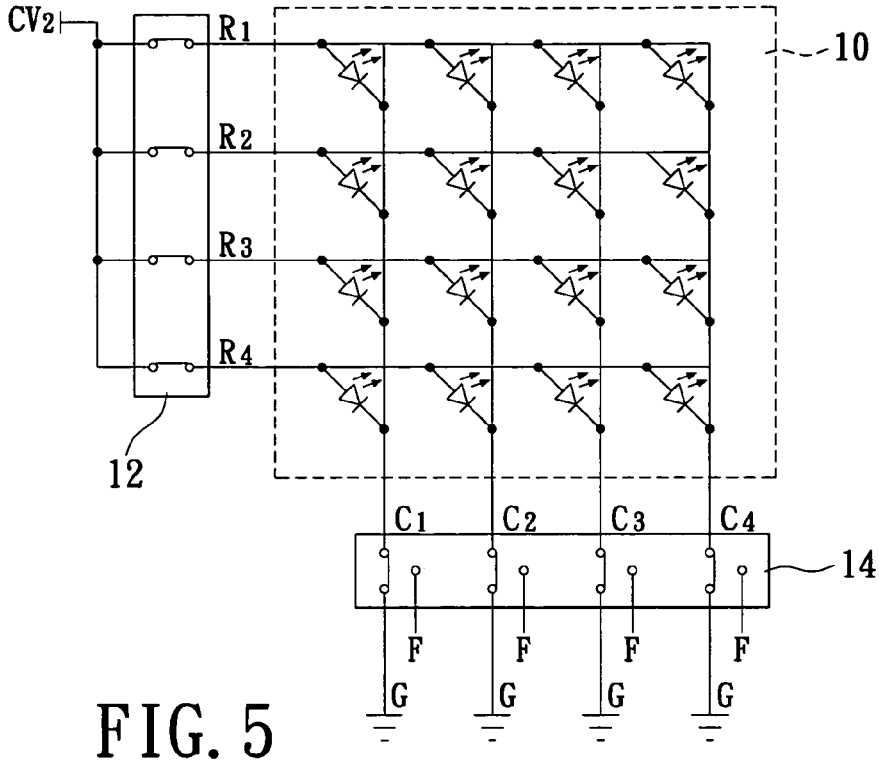
FIG. 5 is a schematic diagram of a driving circuit with the third mode in accordance with the present invention.

Reference is made to FIG. 2 together with FIG. 5, which is a schematic diagram of a driving circuit with the third mode in accordance with the present invention. As shown in the figure, the exemplary embodiment has a display 10 with a 4×4 LED array. The control unit 16 sends a mode-switching signal to the row control interface 12 to make its input ends switch to the second DC power CV2 and pass the electric power of the second DC power CV2 to the row lines (R1, R2, R3 . . . Rn). The second DC power CV2 is provided by the power unit 17.

At the same time, the control unit 16 will send the mode-switching signal to the column control interface 14 to make the input ends of the column control interface 14 switch to the grounds G or floating contacts F. In this embodiment, the column lines (C1, C2, C3 . . . Cn) are connected with the grounds G. At this time, the display 10 will emit light fully.

In the description above, the driving mode of the display 10 employs the row lines for obtaining DC power and the column lines for grounding (this is the full light-emitting state).

Figure 6:
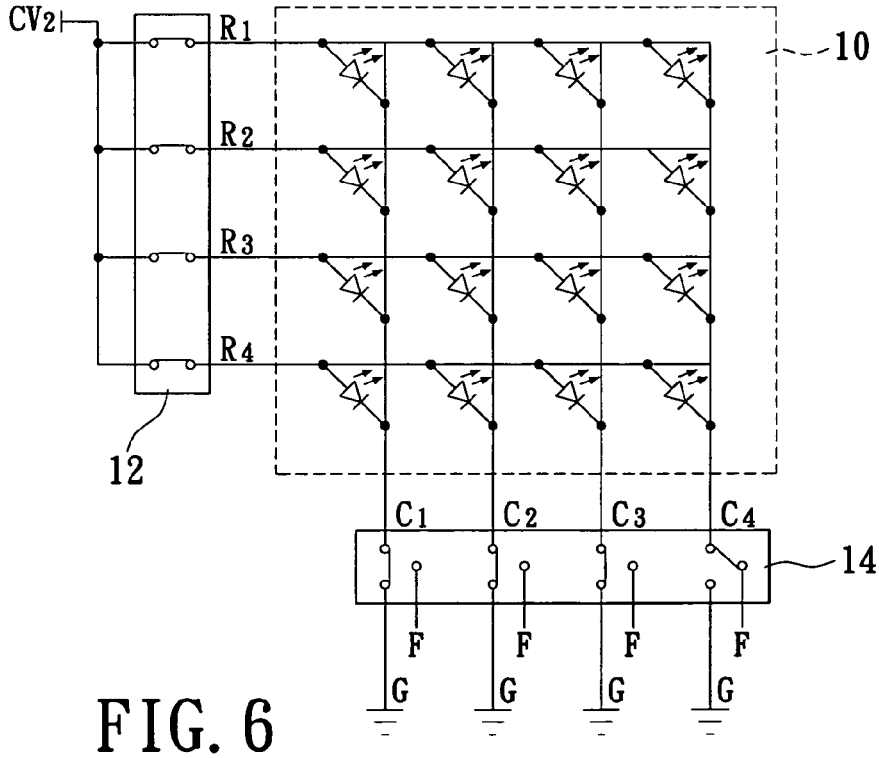
FIG. 6 is a schematic diagram of a driving circuit with the fourth mode in accordance with the present invention

Reference is made to FIG. 2 together with FIG. 6, which is a schematic diagram of a driving circuit with the fourth mode in accordance with the present invention. As shown in the figure, the exemplary embodiment has a display 10 with a 4×4 LED array. The control unit 16 sends a mode-switching signal to the row control interface 12 to make its input ends switch to the second DC power CV2 and pass the electric power of the second DC power CV2 to the row lines (R1, R2, R3 . . . Rn). The second DC power CV2 is provided by the power unit 17.

At the same time, the control unit 16 will send the mode-switching signal to the column control interface 14 to make the input ends of the column control interface 14 switch to the grounds G or floating contacts F. As shown in FIG. 6, the column lines C1–3 are connected with the grounds G and the column line C4 is connected with the floating contact F. At this time, the display units connected with the column lines C1–3 will emit light fully, but the display units connected with the column lines C4 won't emit light.

In the description above, the driving mode of the display 10 employs the row lines for obtaining DC power and employs the column lines for grounding or connecting the floating contacts in accord with the mode-switching signal.

Summing up, the circuit for driving the LED display complying with the present invention has the driving modes as follows: row lines for scanning and column lines for inputting data signals, column lines for scanning and row lines for inputting data signals, row lines for obtaining DC power and column lines for grounding, and row lines for obtaining DC power and column lines for grounding or connecting the floating contacts in accord with the mode-switching signal.

Therefore, the circuit for driving the LED display complying with the present invention can improve the conventional LED display, which lacks flexible control. Hence, the advertisement board, announcement board, traffic light or outdoor television wall made of the LED display complying with the present invention can have the most flexible, economic, power-saving and efficient control for emitting light.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are embraced within the scope of the invention as defined in the appended claims.

What is claimed is:

1. A circuit for driving a light-emitting diode (LED) display, the LED display having at least a display unit and the display unit connecting with a row line and a column line, the circuit comprising:

a control unit for outputting a mode-switching signal;

a scan driving chip connecting with the control unit for providing a scan signal;

a data driving chip connecting with the control unit and the scan driving chip for providing a data signal;

a row control interface connecting with the row line, the control unit, the scan driving chip and the data driving chip to receive the mode-switching signal for switching an input end of the row control interface; and a column control interface connecting with the column line, the control unit, the scan driving chip and the data driving chip to receive the mode-switching signal for switching an input end of the column control interface.

2. The circuit as claimed in claim 1, wherein the display unit is an LED.

3. The circuit as claimed in claim 1, wherein the display unit is an organic LED.

4. The circuit as claimed in claim 1, wherein the data signal is an electric current signal.

5. The circuit as claimed in claim 1, further having a power unit connecting with the control unit and the row control interface for providing a direct current (DC) power to the row line and the circuit.

6. The circuit as claimed in claim 5, wherein the DC power is a first DC power.

7. The circuit as claimed in claim 5, wherein the DC power is a second DC power.

* * * * *